US005443535A

United States Patent [19]

Oda

[11] Patent Number: 5,443,535

[45] Date of Patent: Aug. 22, 1995

[54] METHOD OF MANUFACTURING A SLIDE FASTENER

[75] Inventor: Kiyoshi Oda, Namerikawa, Japan

[73] Assignee: Yoshida Kogyo K.K., Tokyo, Japan

[21] Appl. No.: 293,436

[22] Filed: Aug. 19, 1994

Related U.S. Application Data

[62] Division of Ser. No. 78,105, Jun. 18, 1993, Pat. No. 5,400,482.

[30] Foreign Application Priority Data

Jun. 30, 1992 [JP] Japan ..... 4-172203

[51] Int. Cl.[6] ..... B23P 17/00; B21D 53/50

[52] U.S. Cl. ..... 29/408; 29/418

[58] Field of Search ..... 29/408, 418, 767, 768; 24/433, 434

[56] References Cited

U.S. PATENT DOCUMENTS

| | | |
|---|---|---|
| 3,110,904 | 11/1963 | Feinstein . |
| 3,964,136 | 6/1976 | Panzeri . |
| 4,023,241 | 5/1977 | Kanzaka . |
| 4,137,608 | 2/1979 | Moertel . |
| 4,223,425 | 9/1980 | Akashi . |
| 4,270,248 | 6/1981 | Akashi . |
| 4,752,992 | 6/1988 | Kondo et al. . |

FOREIGN PATENT DOCUMENTS

| | | |
|---|---|---|
| 0051219 | 5/1982 | European Pat. Off. . |
| 0417773 | 3/1991 | European Pat. Off. . |
| 1423000 | 11/1965 | France . |
| 2510098 | 9/1975 | Germany . |
| 4024839 | 2/1992 | Germany . |
| 50-31122 | 9/1975 | Japan . |
| 51-4804 | 2/1976 | Japan . |
| 3-3272 | 1/1991 | Japan . |
| 553551 | 5/1943 | United Kingdom . |
| 944155 | 12/1963 | United Kingdom . |
| 2177752 | 1/1987 | United Kingdom . |

*Primary Examiner*—P. W. Echols

*Attorney, Agent, or Firm*—Hill, Steadman & Simpson

[57] ABSTRACT

A slide fastener comprises a pair of stringer tapes, a pair of rows of interdigitating fastener elements mounted on the inner longitudinal marginal edges of the respective stringer tapes, and a slider for reciprocally movable along the fastener element rows to bring the fastener element rows into or out of interdigitating engagement with each other and a bottom stop mounted on the lower end of the element rows to stop the descent of the slider. The slide fastener also includes a terminal latch member mounted on the fastener element rows at their upper end for letting the slider move therebeyond and coupling the respective one ends of the fastener element rows to each other to thus maintaining the fastener element rows into interdigitating engagement with each other.

2 Claims, 4 Drawing Sheets

METHOD OF MANUFACTURING A SLIDE FASTENER

This is a division of application Ser. No. 08/078,105, filed Jun. 18, 1993 now U.S. Pat. No 5,400,482.

BACKGROUND OF THE INVENTION

1. Field of the Invention

The present invention relates to a slide fastener used for joining cover sheets for seats of cars, or joining carpets, or tapestries and constructed to let a slider slip off in use.

2. Description of the Prior Art

The first type of slide fastener is used mainly for joining cover sheets for seats of cars. In this type of slide fastener, after a slider moves all the way to the terminal end of the slide fastener for joining the cover sheets, the slider is left to remain on the terminal end.

The second type of slide fastener used for joining carpets, artificial turf-mats for ball parks is described in Japanese Utility Model Publication No. 50-31122 and Japanese Utility Model Publication No. 51-4804. This type of slide fastener has no end stop on one end or the upper end. In use, a slider moves the length the slide fastener and passes beyond the upper end so that it slips off the slide fastener. The absence of an upper end stop is made up for by a separate bifurcated wire clip or a bifurcated flat plate clip, which clasp the terminal end of the slide fastener in order to keep the cover sheets from accidental separation.

Japanese Utility Model Publication No. 3-3272 discloses the third type of slide fasteners used on an annular head rest of a seat of an automobile. The slide fastener has one end provided with a pin-and-box type separate device and the other end provided with no end stop so as to permit a slider to pass beyond said other end and slip off the slide fastener. After the slider slips off the slide fastener, a separate annular clam is fitted over the slide fastener to prevent the slide fastener from separating from each other.

However, these conventional slide fasteners suffer from disadvantages.

In case that the first type of slide fastener is used on a cover sheet for a car seat, the slider left on the terminal end of the slide fastener is prone to impart to a driver or a passenger an offensive feeling. That is why this type of slide fastener is limited very much in the application. Furthermore, the slider is likely to accidentally slip away from the terminal end of the slide fastener under severe stresses, thus opening the slide fastener unexpectedly.

The second type of fastener is quite free from the offensive feeling which would be caused by a slider's remaining at the terminal end of the slide fastener. However, after the slider slips off the slide fastener, the separate wire or plate clip must be clipped to the terminal end of the slide fasteners so as to prevent accidental opening of the slide fastener. Moreover, the clip must have mechanical strength enough to put up with severe stresses which are likely to be exerted on the sheets. If it is deficient in strength, the clip will break or get detached from the slide fastener under severe stresses.

The third type of slide fastener has the annular clamp fitted thereover at its terminal end. Since being bulky, the annular clamp makes the overlying cover sheet swollen locally and causes an unpleasant feeling on a passenger.

SUMMARY OF THE INVENTION

With the foregoing difficulties in view, it is an object of the present invention to provide a slide fastener wherein the abovementioned drawbacks have been fully overcome.

It is another object of the present invention to provide a slide fastener which, once closed, can be firmly maintained in closed disposition, and which will never cause offensive feeling on a user.

According to one aspect of the present invention, there is provided a slide fastener comprising a pair of stringer tapes, a pair of rows of interdigitating fastener elements mounted on the inner longitudinal marginal edges of the respective stringer tapes, a slider for reciprocally mounting on and along the fastener element rows to bring the fastener element rows into or out of interdigitating engagement with each other and a terminal latch member mounted on the fastener element rows at their one end for letting the slider pass therebeyond and locking the respective one ends of the fastener element rows to each other to thus maintaining the fastener element rows into interdigitating engagement With each other.

According to another aspect of the present invention, there is provided a method of manufacturing a slide fastener from a continuous slide fastener chain; the method comprising the steps of: providing a continuous slide fastener chain comprising a pair of continuous stringer tapes and a succession of fastener element rows mounted at intervals on inner longitudinal marginal edges of the continuous stringer tapes with element-free space portions interposed between each adjacent pair of fastener element rows; threading a slider from its flared front end through the foremost element-free space portions of the stringer tapes into reciprocal engagement with the foremost element rows; mounting a bottom stop to the fastener element rows at their leading end; mounting a pair of opposed first and second lugs on trailing ends of the foremost element rows, the first lug having a plug projecting toward the second lug, the second lug having a socket open toward the first lug for coupling engagement with the plug, the width and the thickness of the first and second lug as coupled being equal or slightly less than the width and the thickness of the fastener element rows as coupled; and severing the continuous slide fastener chain across the ensuing element-free space portion.

Many other advantages and features of the present invention will become manifest to those versed in the an upon making reference to the detailed description and the accompanying sheets of drawings in which preferred structural embodiments incorporating the principles of the present invention are shown by way of the illustrative example.

DETAILED DESCRIPTION

Figure 1:
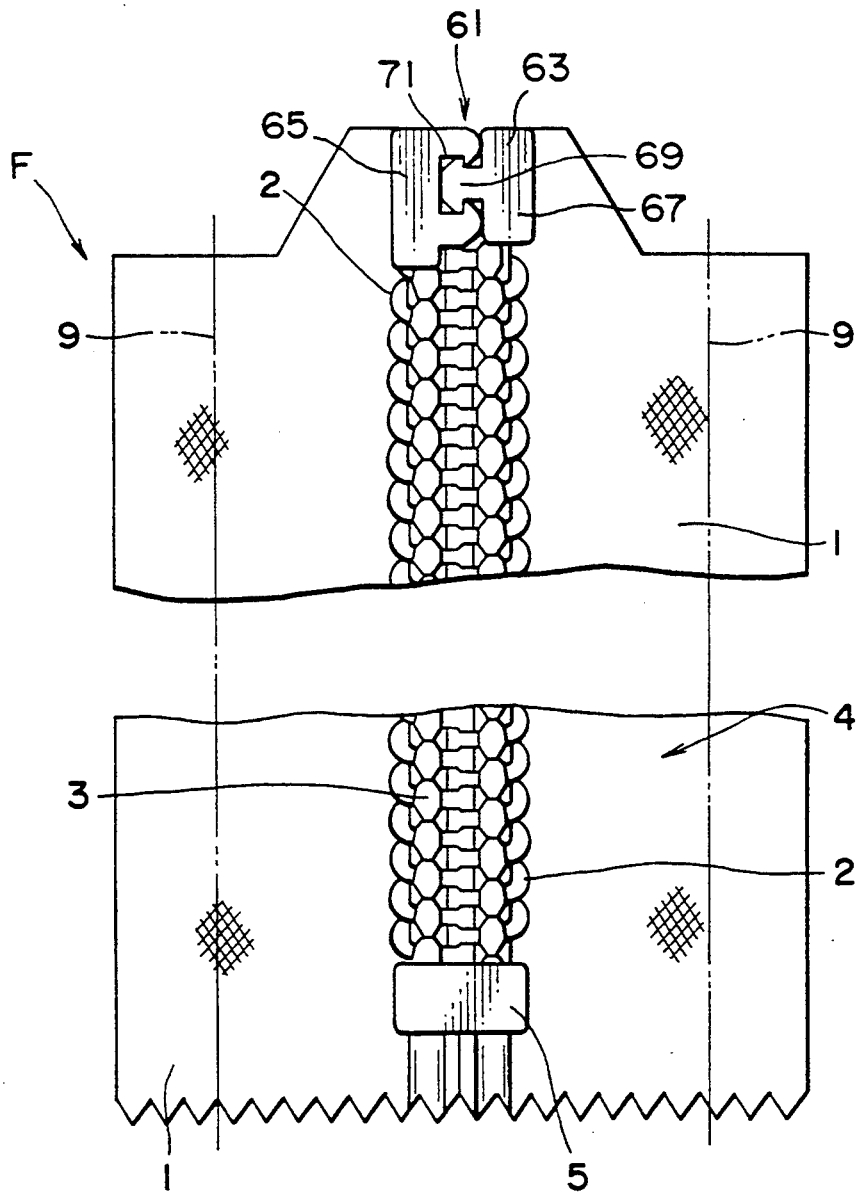
FIG. 1 is a partially-cut-away front view of a slide fastener according to the present invention.

Referring to FIG. 1, a slider fastener F according to the present invention comprises a pair of stringer tapes 1, 1 and a pair of rows of coiled type interdigitating fastener elements 2, 2 sewn to the inner longitudinal marginal edges of the respective stringer tapes 1, 1 by means of sewing stitches 3. Although coiled type plastic fastener elements 2, 2 are shown here in the drawings, the invention may apply to other types of fastener elements, such as fastener elements of meander type, injection-molded discrete plastics type, even of metal type.

A slider 35 (not shown in FIG. 1 but shown in FIG. 6) is reciprocally mounted on and along the rows of fastener elements 2, 2 to bring the fastener element rows 2, 2 into or out of interdigitating engagement with each other in such a way as is well known in this field. The slider 35 comprises a slider body 37 and a pull tab 39 for manipulation of the slider body 37. The slider body 37 has an attachment lug 41 mounted on its upper surface. The pull tab 39 is pivotally mounted on the attachment lug 41. The slider body 37 has a flared front end 37*a* and a converged rear end 37*b* and has a Y-shaped channel (not shown) formed therethrough. The Y-shaped channel is bifurcated at the flared front end 37*a*; so that, as the fastener element rows 2, 2, move through the Y-shaped channel of the slider 35 from the flared front end 37*a*, in other words, as the slider 35 moves upward as viewed in FIG. 1, the fastener element rows 2, 2 are brought into interdigitating engagement with each other.

A bottom end stop 5 is mounted on the lower end of the fastener element rows 2, 2 for preventing the slider 35 from descending therebeyond and slipping off the fastener element rows 2,2.

Importantly, as shown in FIG. 1, a terminal latch member 61 is mounted on the upper end of the fastener element rows 2, 2 and is adapted for letting the slider 35 move therebeyond while locking the respective upper ends of the fastener element rows 2, 2 to each other, to thus maintain the fastener element rows 2, 2 into interdigitating engagement with each other, as closely described hereinbelow.

Figure 2:
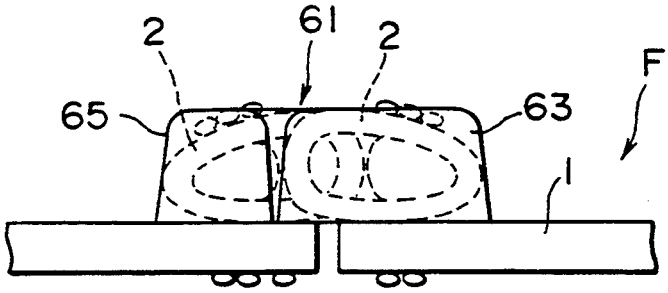
FIG. 2 is a plan view of the slide fastener of FIG. 1.

The terminal latch member 61 is made of plastic and integrally formed with the element rows 2, 2 at their upper ends. The terminal latch member 61 comprises a pair of opposed first and second lugs 63, 65 mounted on the upper ends of the respective element rows 2, 2. The first lug 63 includes a substantially rectangular lug body 67 and an arrow-shaped plug 69 integrally formed with and extending from the inner side of the lug body 67. The second lug 65 is substantially rectangular and has a socket 71 formed in the inner side thereof for coupling engagement with the plug 69. As shown in FIGS. 1, and 2, the width and thickness of the first and the second lug 63, 65 as coupled are to be equal or slightly less than the width and the thickness of the fastener element rows 2, 2, as coupled, which ensures that, while coupled by the slider 35, the first and second lugs 63, 65 let the slider 35 pass beyond themselves and slip off the fastener element rows 2, 2. As better shown in FIG. 1, the opposed first and second lugs 63, 65 protrude upwardly beyond the respective end edge of the stringer tapes 1, 1 so as to be protected from lateral stresses which might be exerted on the opposed stringer tapes 1, 1, tending to pull them apart.

The lower ends of the stringer tapes 1, 1 are shown to be cut in corrugated fashion in FIG. 1, however, they may be cut straight, round or in any other fashion. The two vertical phantom lines 9, 9 in FIG. 1 indicate the stitching line along which the opposed stringer tapes 1, 1, are sewn to relevant parts of an article, such as a sheet cover for a car seat (not shown). The slide fastener F incorporating the bottom end 5 set forth lends itself to an article that no more need to be opened once closed by the slider 35.

Instead of the bottom end 5, a so-called pin-and-box separator (not shown) may be provided on the lower end of the fastener element rows 2, 2. The slide fastener F incorporating the pin-and-box separator is suitable for such an article whose opening must be opened only but occasionally after being closed by the slider.

In use, the slider 35 is slid upward along the fastener element rows 2, 2 by pulling up the pull tab 39, thus bringing the fastener element rows 2, 2 into interdigitating engagement with each other. Eventually, the slider 35 moves beyond the terminal latch member 61 so that the slider 35 slips off the slide fastener F and at the same time brings the first and second lugs 63, 65 into coupling engagement with the each other.

Figure 3:
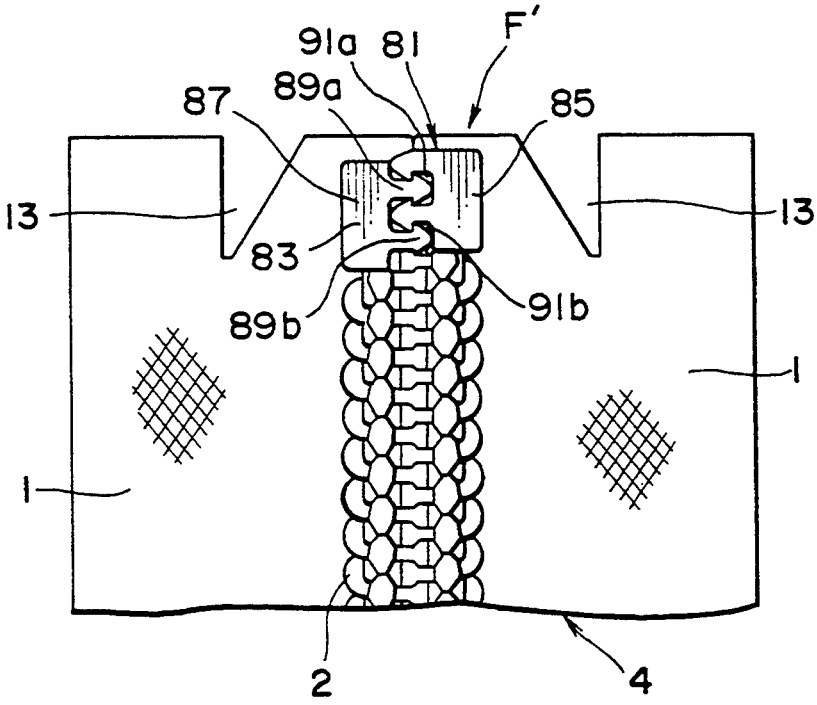
FIG. 3 is a fragmental front view of a slide fastener according to another embodiment of the present invention.

FIG. 3 shows a slide fastener F′ according to a second embodiment of the present invention. The slide fastener F′ is substantially identical with the slide fastener F according to the first embodiment except for the following points. Instead of the one-plug-one-socket engagement in the first embodiment, two-plug-two-socket engagement is made on the terminal latch member 81 in this embodiment. A pair of arrow-shaped plugs 89*a* and 89*b* are integrally formed on and protrude from the inner side of the lug body 87 of the first lug 83. Correspondingly, a pair of sockets 91*a*, 91*b* are formed in the inner side of the second lug 85 so as to be open toward the first lug 85. Each stringer tape 1, 1 has a notch 13 formed on its upper edge adjacent to the terminal latch member 81, which notch 13 extends longitudinally of the tapes 1,1 by the length which is substantially equal to the length of the terminal latch member 81. As better shown in FIGS. 4 and 5, a pair of prongs 14 are integrally formed on the lower side and protrude downward therefrom. The first lug 83 and the second lug 85 are temporarily joined to each other between the plugs 89*a*, 89*b* and the corresponding sockets 91*a*, 91*b* by a thin and fragile temporary bridges 15*a*, 15*b*, respectively. The first and second lugs 83, 85 are attached to the respective tapes 1, 1, while remaining joined by the bridges 15*a*, 15*b*, by making the prongs 14 pierce the stringer tapes 1, 1 and welding the projecting prongs 14 integrally to the stringer tapes 1, 1. After the attachment of the first and second lugs 83, 85 to the stringer tapes 1, 1, the thin temporary bridge 15*a*, 15*b* are broken, thus providing the terminal latch member 81.

Description is now made of a method of manufacturing the slide fastener F incorporating the terminal latch member 6 set forth hereinabove from a continuous slide fastener chain 23.

Figure 6:
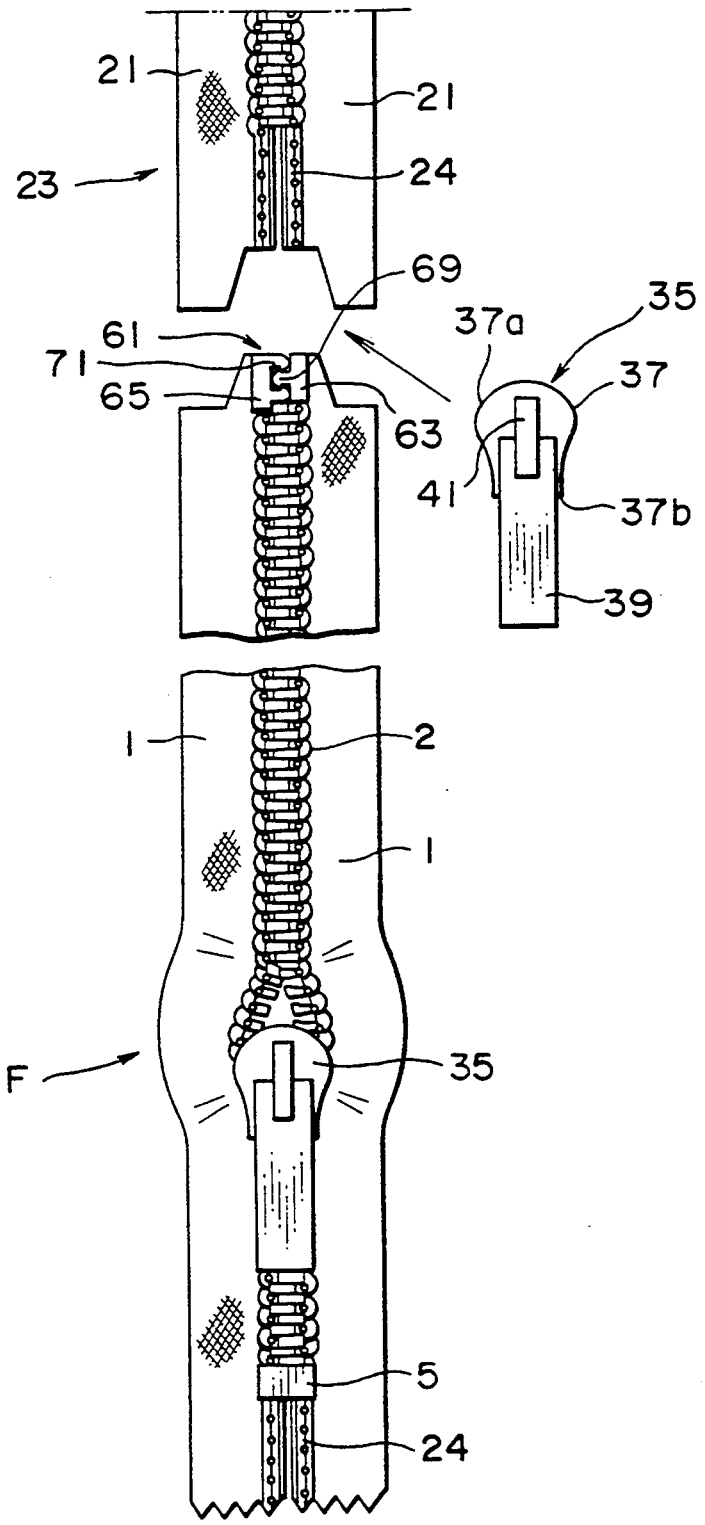
FIG. 6 is an explanatory view showing a method of manufacturing slide fastener of FIG. 1 from a continuous slide fastener chain.

FIG. 6 shows a foremost end of a continuous slide fastener chain 23, a product-length slide fastener F just cut off the continuous slide fastener 23 and now ready for withdrawal to a storing container (not shown), a separate slider 35 ready for insertion into engagement with fastener element rows 2,2.

The continuous fastener chain 23 comprises a pair of continuous stringer tapes 21, 21 and a succession of fastener element rows 2, 2 mounted at regular intervals on their inner longitudinal marginal edges of the continuous tapes 21, 21 with an element-free space portion 24, 24 interposed between each adjacent fastener element row 2, 2.

After the cut-off slide fastener F is withdrawn for storing, a slider 35 is threaded from its flared front end 37*a* through the element-free space portion 24 of the stringer tapes 21, 21 into reciprocal engagement with the foremost fastener element rows 2, 2. After the slider 35 moves up slightly along the fastener element rows 2, 2, a bottom stop 5 is mounted on the foremost fastener element rows 2, 2 at their leading ends.

And then, a pair of first and second opposed lugs 63, 65 both made of plastic are mounted on the trailing ends of the respective foremost fastener element rows 2, 2. The first lug 63 has the plug 69 extending toward the second lug 65. The second lug 65 has the socket 71 open toward the first lug 63 for coupling engagement with the plug 69. As mentioned earlier, the width and the thickness of the first and second lug 63, 65 as coupled are equal or slightly less than the width and the thickness, respectively, of the fastener element rows 2, 2 as coupled. Eventually, the continuous slide fastener chain 23 is severed across the ensuing element-free space portion 24, to thus provide a product-length slide fastener F incorporating the slider 35, the bottom stop 5 and the terminal latch member 61. The severance of the continuous slide fastener chain 23 is made along such a cutting line that the terminal latch member 61 protrudes beyond the relevant end edge of the stringer tapes 1, 1. The end of the stringer tapes 1, 1 which is adjacent to the bottom end stop 6 may be cut in corrugated fashion, as shown in FIGS. 1 and 6, or any other fashion later on.

Figure 4:
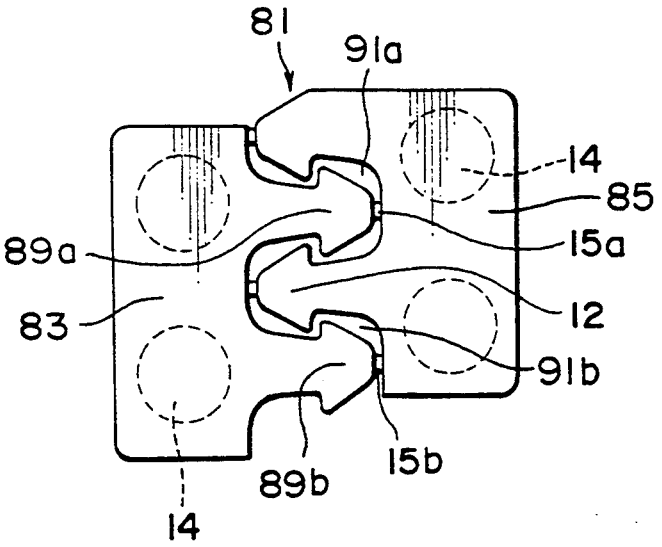
FIG. 4 is a front view of a terminal latch member according to a still another embodiment of the present invention.
Figure 5:
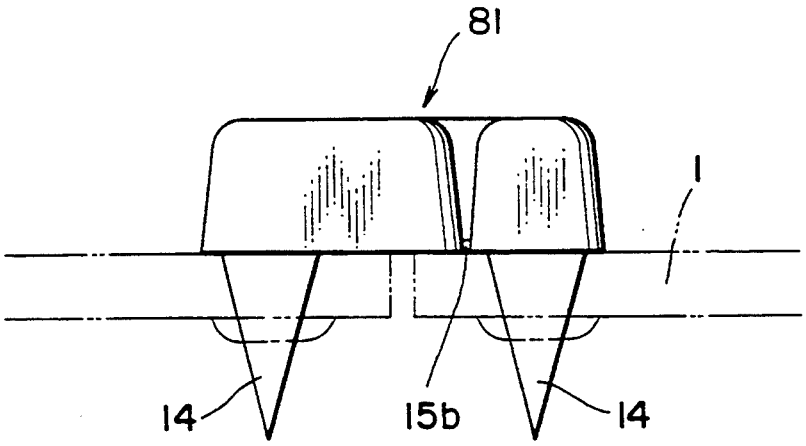
FIG. 5 is a base view of the terminal latch member of FIG. 3.

The first and second opposed lugs 63, 65 may be injection-molded integrally with the respective foremost element rows 2, 2 at their trailing ends. Alternatively, the first and second lugs 83, 85 may be molded separately from the fastener element rows 2, 2 beforehand. As shown in FIG. 3 and 4 each of the first and second lugs 83, 85 has a pair of prongs 14 extending downward from the rear side thereof and disposed longitudinally of the lug 83, 85. The first and second lug 83, 85 are joined by the two temporary thin bridges 15*a*, 15*b*. The first and second lug 83, 85 thus joined by the temporary bridges 15*a*, 15*b* are mounted on the trailing ends of the foremost fastener element rows 2, 2 with the prongs 14 piercing the respective stringer tapes 1, 1. Then, the protruding ends of the prongs 14 passing beyond the stringer tapes 1, 1 are welded, such as by ultra-sonic horn, as indicated by phantom lines in FIG. 4, so that the first and second lug 83, 85 are firmly mounted on the stringer tapes 1, 1. Eventually, the temporary thin bridges 15*a*, 15*b* is removed to thus provide a product-length slide fastener F incorporating the slider 35, the bottom stop 5 and the terminal latch member 61.

With the construction set forth hereinabove, the present invention enjoys the following advantageous effects.

The terminal latch member mounted on one end of the fastener element rows lets the slider pass therebeyond while keeping the fastener element rows into interdigitating engagement with each other. Therefore, in case the slide fastener is used on a sheet cover for a car seat, the slide fastener never imparts any offensive feeling to a driver or a passenger which would be caused by having a slider left thereon.

Furthermore, since the terminal latch member protrudes far beyond the respective end edge of the stringer tapes, the terminal latch member is free from severe tensions, tending to spread them laterally apart.

Obviously, various modifications and variations of the present invention are possible in the light of the above teaching. It is therefore to be understood that within the scope of the appended claims the invention may be practice otherwise than as specifically described.

What is claimed is:

1. A method of manufacturing a slide fastener comprising the steps of:

providing a continuous slide fastener chain comprising a pair of continuous stringer tapes and a succession of fastener element rows mounted at intervals on inner longitudinal edges of the continuous stringer tapes with element-free space portions interposed between each adjacent fastener element rows;

providing a slider with a flared front end;

threading a slider from its flared front end through the foremost element-free space portions of the stringer tapes into reciprocal engagement with the foremost element rows;

mounting a bottom stop to the fastener element rows at their leading end;

mounting a pair of opposed first and second lugs on trailing ends of the foremost element rows, the first lug having a plug projecting toward the second lug, the second lug having a socket open toward the first lug for coupling engagement with the plug, the width and the thickness of the first and second lug as coupled being equal or slightly less than the width and the thickness of the fastener element rows as coupled; and severing the continuous slide fastener chain across the ensuing element-free space portion.

2. A method according to claim 1, wherein the step of mounting a pair of opposed first and second lugs is further defined in that each of the first and second lugs have a rear side and are made of plastic and have a prong projecting from the rear side thereof, the first and second lugs being joined by a temporary bridge; the first and second lugs thus joined being mounted on the ends of the corresponding fastener element rows with their prong piercing the respective stringer tapes and welded integrally thereto, and removing the temporary bridge.

* * * * *

UNITED STATES PATENT AND TRADEMARK OFFICE

CERTIFICATE OF CORRECTION

PATENT NO. : 5,442,535
DATED : August 15, 1995
INVENTOR(S) : Jean-Marie Bourgeois It is certified that error appears in the above-indentified patent and that said Letters Patent is hereby corrected as shown below:

On the Title Page, Item [75] Inventor, should read
Jean-Marie Bourgeois, Roqueford la Bedoule, France Item [19] should read --Bourgeois Signed and Sealed this Eighteenth Day of June, 1996

*Attest:*

*Attesting Officer*

BRUCE LEHMAN

*Commissioner of Patents and Trademarks*